US005528015A

United States Patent [19]

von Blanquet et al.

[11] Patent Number: 5,528,015

[45] Date of Patent: Jun. 18, 1996

[54] DISPLAY-AND-CONTROL PANEL FOR A COOKING SURFACE

[75] Inventors: Georg von Blanquet, Baden-Baden; Gerhard Rothenberger, Gaggenau; Joachim Roth, Forbach; Joachim Damrath; Bruno Wörner, both of Gaggenau; Helmut Bastian, Baden-Baden, all of Germany

[73] Assignee: Gaggenau-Werke Haus-und Lufttechnik GmbH, Gaggenau, Germany

[21] Appl. No.: 253,637

[22] Filed: Jun. 3, 1994

[30] Foreign Application Priority Data

Jun. 9, 1993 [DE] Germany ..... 43 19 170.3

[51] Int. Cl.[6] ..... H05B 3/68

[52] U.S. Cl. ..... 219/453; 219/464

[58] Field of Search ..... 219/443, 453, 219/464, 466–468, 445–446, 448, 458–459, 451

[56] References Cited

U.S. PATENT DOCUMENTS

| | | | |
|---|---|---|---|
| 3,154,357 | 10/1964 | Urbank | 219/464 |
| 3,838,505 | 10/1974 | Doner | 219/464 |
| 3,927,658 | 12/1975 | Olthuis | 219/464 |
| 4,394,565 | 7/1983 | Dills | 219/453 |
| 4,492,217 | 1/1985 | Scheidler | 219/464 |
| 5,432,320 | 7/1995 | Scheidler | 219/464 |

FOREIGN PATENT DOCUMENTS

| | | |
|---|---|---|
| 2654571 | 10/1989 | France . |
| 8701926 | 9/1987 | Germany . |
| 3802406 | 1/1988 | Germany . |
| 402210 | 6/1963 | Switzerland . |
| 2125537 | 6/1983 | United Kingdom . |

*Primary Examiner*—Teresa J. Walberg
*Assistant Examiner*—Sam Paik
*Attorney, Agent, or Firm*—Sprung Horn Kramer & Woods

[57] ABSTRACT

An electric range top has a cooking surface with at least one hotspot and a display-and-control panel for the cooking surface. The panel accommodates display devices and manually operated control devices for regulating each hotspot. The cooking surface has a cutout in one corner wherein the panel is mounted. One area of the cooking surface is elevated and at least partly overlaps the cutout and the display and control devices are positioned in the vicinity of the elevated area.

10 Claims, 2 Drawing Sheets

DISPLAY-AND-CONTROL PANEL FOR A COOKING SURFACE

BACKGROUND OF THE INVENTION

The present invention concerns a display-and-control panel for a cooking surface with at least one hotspot, especially for a built-in recessed electric-range top. The panel accommodates display devices and manually operated control devices. The display-and-control devices regulate electronic controls. The controls generate signals that actuate current-diverting components in a heating element associated with each hotspot. The display-and-control panel is accommodated in a cutout at one corner of the cooking surface.

Electric ranges and built-in recessed electric-range tops are equipped with manually operated devices that allow the user to control how much heat radiates from the heating elements in each hotspot. The manually operated devices may be combined with appropriate display devices into display-and-control panels. The display devices indicate the state of the individual hotspots, temperatures, and other information for example.

Known simple control devices are rotating knobs, although finger-contact sensors can also be employed. Also known are display devices in the form of light-emitting diodes.

The point of departure for the present invention is a known cooking surface with display-and-control devices integrated into it. The display-and-control devices associated with different hotspots are combined into display-and-control panels in known electric ranges and built-in recessed electric-range tops. The design is especially typical for cooking surfaces of heat-resistant glass, like the vitreous ceramic sold under the brand Ceran. The advantage of integrating the display-and-control devices essentially into the same plane as the cooking surface is that they will be in the field of vision and within the reach of a user looking down, increasing efficiency and convenience.

The standard thickness of the kitchen-counter tops that such recessed electric-range top are intended to be built into is a relatively slight 40 mm, which for practical purposes should not be exceeded when the top is installed. Since the vitreous ceramic cooking surface should essentially not be thicker than the counter, it would seem difficult to accommodate the heat-sensitive electronic components along with display-and-control devices in the shallow depth available. Another problem is how to dispose of losses from the current-diverting components in the form of heat, possibly enough to damage the electronics, especially the sensors and controls. It has accordingly been impossible until now to accommodate these components in relatively shallow appliances while complying with the aforesaid standard.

A cooking surface with its display-and-control devices concentrated into a panel in one corner is known from German 3 802 406 A1. Since the panel is on the same level as the cooking surface, there is not enough depth to accommodate the display-and-control devices. There is also a gap that spilled food can enter between the panel and the cooking surface.

Also part of the state of the art is a current-presence display described in Swiss Patent 402 210. A panel inserted into the countertop outside the cooking surface contains display-and-control devices. The panel is accordingly not accommodated in one corner of the cooking surface, but next to it. There is no problem in ensuring enough depth for the devices because the panel itself is deep enough.

SUMMARY OF THE INVENTION

The point of departure for the present invention is accordingly a display-and-control panel that will combine the convenience of concentrating its display-and-control devices in one corner with the advantage of a more effective lost-heat diversion in a shallow depth, eliminating the aforesaid drawbacks of the known embodiments.

This object is attained in accordance with the present invention in that one area of the cooking surface is elevated and at least partly overlaps the display-and-control panel accommodating cutout. Extra depth is accordingly obtained by increasing the overall thickness by at least the thickness of the cooking surface. The temperature in the vicinity of the electronic components will be low enough to avoid damage. All the electronics can be accommodated along with the power supply in the relatively shallowly recessed electric-range top.

The display-and-control devices in one preferred embodiment of the invention are accommodated below the elevated area of the cooking surface. It is practical for the control devices to be finger-contact sensors. Finger-contact sensors and surface-level display devices will make the display-and-control panel easy to wipe clean.

It will be of advantage for the cooking surface to be vitreous ceramic.

One embodiment of the invention can include a heat-radiating rail that communicates with at least one current-diverting component. The electronic controls can in this embodiment also be accommodated below the elevated area of the cooking surface. This tactic will increase cooling.

Thermal stress on the electronics can be decreased even further by exploiting an existing elevated metal edge around the cooking surface as a radiator. Such an edge can communicate with at last one current-diverting component. Such an embodiment can also be employed with display-and-control panels to increase cooling when the cooking surface does not have an elevated area. It will also be practical for the heat-radiating rail in the vicinity of the panel-accommodating cutout to communicate with the elevated metal edge.

When, as in one practical embodiment of the invention, the display-and-control panel is at a front corner of the cooking surface, the panel will be far enough away from the heating elements at the hotspot to significantly decrease thermal stress. The elevated area of the cooking surface can be a triangle, sector, rectangle or other shape or combination thereof.

It can also be practical in order to increase the available installation depth below the elevated area of the cooking surface to interpose a spacer between the area and the surface below it.

The elevated area of the cooking surface in one preferred embodiment is vitreous ceramic. The area can also conveniently be secured to the surface by heat-resistant cement.

One embodiment of the invention will now be specified with reference to the accompanying drawing, wherein

DETAILED DESCRIPTION OF THE INVENTION

Figure 1:
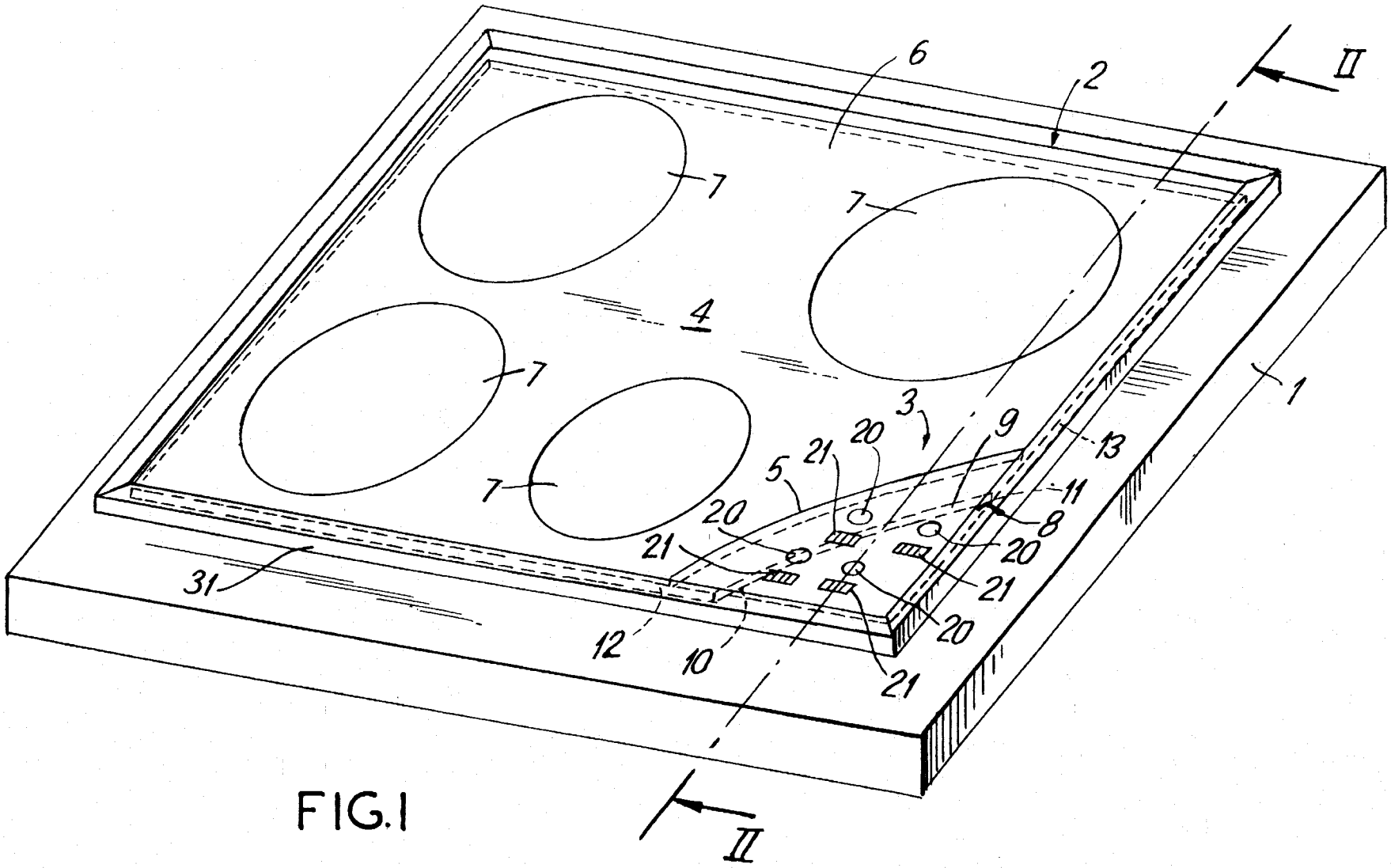
FIG. 1 is an isometric view of a built-in recessed electric-range top with a display-and-control panel in accordance with the present invention.

FIG. 1 illustrates a recessed electric-range top 2 installed in an aperture in a countertop 1. Range top 2 has an essentially rectangular vitreous ceramic cooking surface 4. There is a display-and-control panel 5 at one corner 3 at the front of surface 4.

The top of cooking surface 4 is smooth and flat. It incorporates four hotspots 7. Below each hotspot 7 is an unillustrated heating element. There is a triangular cutout 8 at corner 3. A matching area 9 of vitreous ceramic is cemented over cutout 8 and evenly overlapping it to an extent B (cf. FIG. 2). One edge 10 of area 9 is in alignment with one edge 12 of cooking surface 4 and the other edge 11 of elevated area 9 in alignment with the other edge 13 of cooking surface 4.

Figure 2:
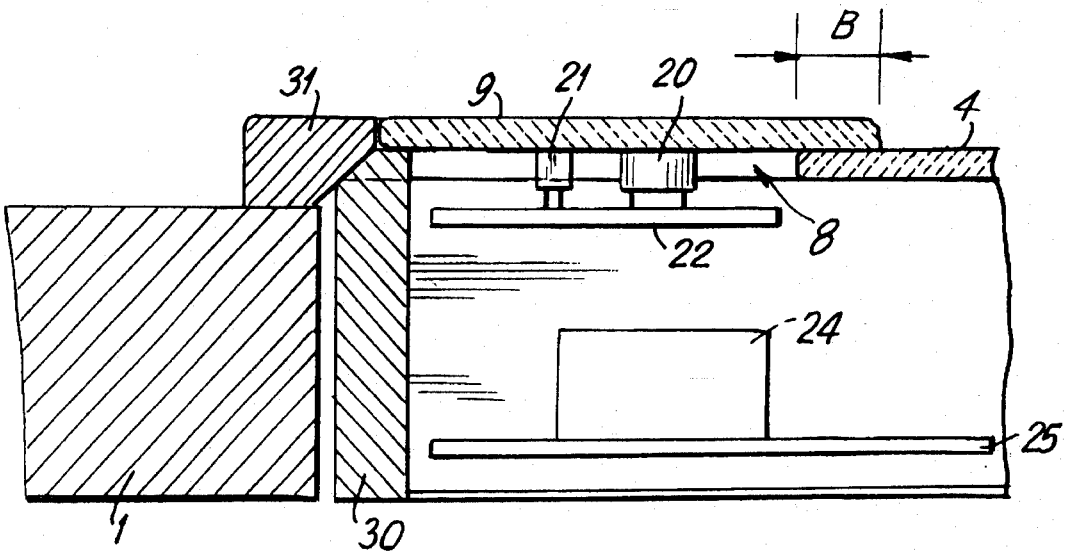
FIG. 2 is a section along the line II—II in FIG. 1 of a display-and-control panel resting on the cooking surface.

As will be evident from FIGS. 1 and 2, area 9 accommodates a control device in the form of a sensor 20 and a display device in the form of a light-emitting diode 21 for each hotspot 7. Each diode 21 indicates the state established by sensor 20. Unillustrated conductors convey electric signals from sensors 20 to electronic controls 22 below area 9. Controls 22 generate in response to the actuation of sensors 20 signals that regulate current-diverting components 24. Components 24 control the supply of current to the heating elements below hotspots 7. The current-diverting components 24 in the present embodiment are triacs.

The relatively intense heat losses released by current-diverting components 24 in the vicinity of the display-and-control panel are conducted to a heat-radiating rail 30. Cooling can be improved by connecting rail 30 to an elevated metal edge 31 around cooking surface 4 and area 9. Edge 31 is constructed of aluminum section and constitutes an additional radiator. The edge can alternatively be directly connected to the bases of the current-diverting components.

Figure 3:
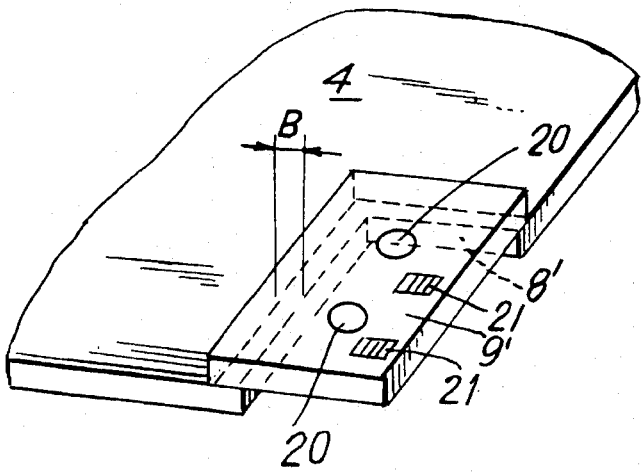
FIG. 3 is a partial isometric view of another embodiment of the invention with a rectangular elevated area.

As shown in FIG. 3, the elevated area 9' is rectangular and matches the rectangular cutout 8'

Figure 4:
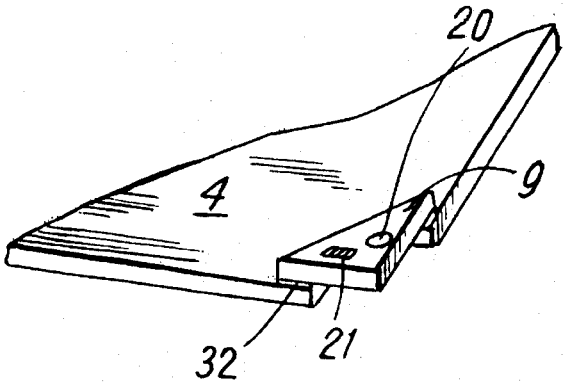
FIG. 4 is a partial isometric view of another embodiment of the present invention having a spacer between the cooking surface and the elevated area.

In FIG. 4, a spacer 32 is disposed between cooking surface 4 and elevated area 9.

It is understood that the embodiments described hereinabove are merely illustrative and are not intended to limit the scope of the invention. It is realized that various changes, alterations, rearrangements and modifications can be made by those skilled in the art without substantially departing from the spirit and scope of the present invention.

What is claimed is:

1. In an electric range top having a cooking surface with at least one hotspot and display devices and manually operated control devices for regulating each hotspot, the improvement wherein the cooking surface has a cutout in one corner, a planar panel mounted above the cutout and at least partly overlapping the cutout and thereby being elevated with respect to the cooking surface and wherein the display devices and control devices are positioned on said elevated panel.

2. The range top as in claim 1, wherein the cooking surface is vitreous ceramic.

3. The range top as in claim 1, further comprising a heat-radiating rail below the panel and connected to at least one current-diverting component.

4. The range top as in claim 1, further comprising electronic controls disposed below the panel.

5. The range top as in claim 1, wherein the panel is triangular.

6. The range top as in claim 1, wherein the panel is a sector.

7. The range top as in claim 1, wherein the panel is rectangular.

8. The range top as in claim 1, wherein the panel and cooking surface comprise the same materials and the panel is cemented to the cooking surface.

9. The range top as in claim 1, further comprising a spacer between the cooking surface and the panel.

10. The range top as in claim 3, further comprising a metal edge around the cooking surface connected to the heat radiating rail.

* * * * *